US006960273B2

(12) United States Patent
Jung

(10) Patent No.: US 6,960,273 B2
(45) Date of Patent: Nov. 1, 2005

(54) PROCESS FOR RENOVATION OF A STAIRCASE

(76) Inventor: Horst R. Jung, Hochstrasse 27, D-63128, Dietzenbach (DE)

( * ) Notice: Subject to any disclaimer, the term of this patent is extended or adjusted under 35 U.S.C. 154(b) by 410 days.

(21) Appl. No.: 10/417,216

(22) Filed: Apr. 17, 2003

(65) Prior Publication Data

US 2004/0206043 A1 Oct. 21, 2004

(51) Int. Cl.[7] ..... B32B 35/00

(52) U.S. Cl. ..... 156/98; 156/94; 156/71; 156/324.4; 156/152.98; 52/741.2; 52/182; 52/514; 52/188; 52/191

(58) Field of Search ..... 156/98, 152, 32, 156/4.4; 52/741.2, 182, 514, 188, 191

(56) References Cited

U.S. PATENT DOCUMENTS

| | | | | |
|---|---|---|---|---|
| 1,536,895 | A * | 5/1925 | Lindyberg | 52/514 |
| 2,842,813 | A * | 7/1958 | Van Fleet | 52/182 |
| 3,552,084 | A * | 1/1971 | Cormier | 52/181 |
| 4,783,939 | A | 11/1988 | Bergmann et al. | |
| 6,318,033 | B1 * | 11/2001 | Birch et al. | 52/182 |
| 6,519,909 | B1 * | 2/2003 | Fawley | 52/721.4 |

FOREIGN PATENT DOCUMENTS

| | | |
|---|---|---|
| DE | 8026427 | 2/1981 |
| DE | 8504095 | 5/1985 |
| DE | 8604260 | 5/1986 |
| DE | 8707245 | 9/1987 |
| DE | 8514515 | 11/1987 |
| DE | 3803077 | 8/1989 |
| DE | 9214772 | 5/1993 |
| EP | 061707 | 10/1982 |
| EP | 312488 | 4/1989 |
| FR | 2671822 | 7/1992 |
| WO | 9514139 | 5/1995 |

* cited by examiner

*Primary Examiner*—Blaine Copenheaver
*Assistant Examiner*—Chris Schatz
(74) *Attorney, Agent, or Firm*—Dennison, Schultz, Dougherty & MacDonald

(57) ABSTRACT

A process for the renovation of the steps of a staircase including step treads and risers, whereby, starting from the top step to be renovated, starting on the step tread thereof, a step tread plate provided with an impact section that protrudes beyond the step tread is arranged and fastened, and whereby, starting from the impact section, a riser plate extends along the riser and is fastened in the area of the corresponding next lower step to be removed.

8 Claims, 2 Drawing Sheets

PROCESS FOR RENOVATION OF A STAIRCASE

Figure 1:
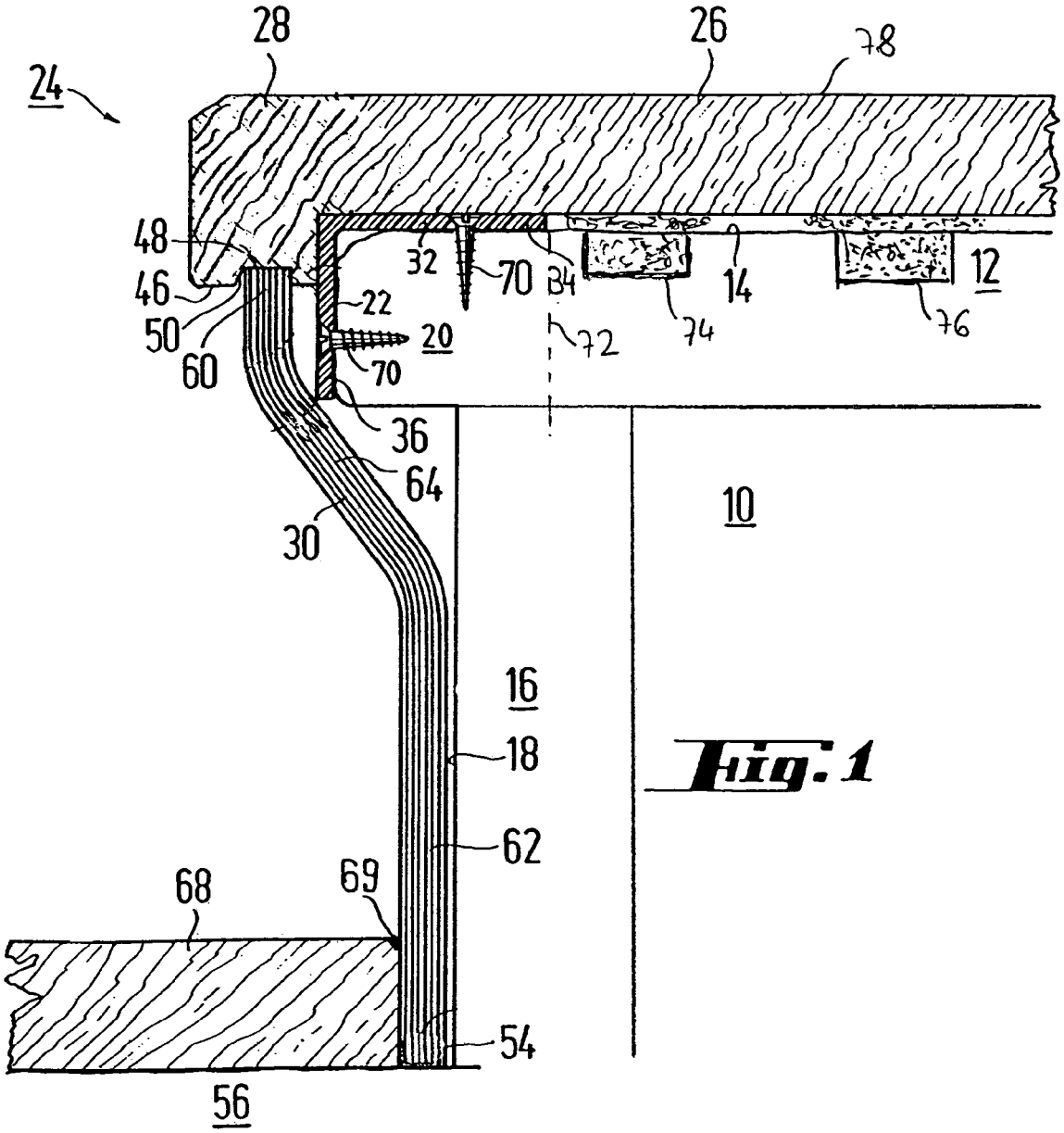

The invention concerns a process for the renovation of the steps of a staircase, comprising step treads and risers, whereby, starting from the top step to be renovated, on the step tread thereof a step tread plate provided with an impact section is arranged and fastened, and whereby, starting from said impact section, a riser plate extends along the riser and is fastened in the area of the corresponding next [lower] step to be renovated.

A process of this type is known from the Applicant's WO 95/14139. In order to cover a step to be renovated with a step tread plate and a riser plate, it is first necessary to shorten the nosing edge of the original step in order to be able to fasten an angular profile. Fastening between the step tread plate and the step tread surface is accomplished by means of curable foam. This gives rise to the disadvantage that when the foam cures quickly the frequently required correction of the step tread plate and/or the riser plate relative to the step tread surface and/or the riser surface is possible only with difficulty.

EP 0 312 488 A2 is based on a process for restoration of a staircase. To this end, new step tread surface elements are used, which are placed on top of the old steps of the staircase and fastened thereto by means of step tread surface profiles. For attachment thereof, an assembly foam is similarly used, with which the hollow spaces between the old steps of the staircase and the new step tread surface elements are filled. The assembly foam used in this way has a reaction time of several hours, during which it increases in volume by up to two times.

DE 92 14 772 U1 discloses a staircase construction element for the renovation of a step in a staircase. Said staircase construction element consists of a step tread plate and a riser plate, which are connected to each other by means of a profile piece, which extends along the nosing edge. The external surfaces of the profile piece, as well as those of the step tread plate and the riser plate, are aligned with each other in a flush-fitting manner.

In order to fasten the staircase construction element to the step in the staircase to be restored, a filler adhesive is used, which also fills up the space between the riser plate and the riser. Such a staircase construction element, however, is not suitable for the restoration of steps, which have a significantly projecting nosing edge. In addition, there is nothing to ensure that the profile piece, which connects the step tread plate to the riser plate, will not break under the influence of strong loads.

In order to prevent this, DE 87 07 245 U1 discloses a kit for the renovation of steps in a staircase. Said kit includes a Z-profile, which is to be attached to the step to be renovated. One side of said Z-profile is screwed on to the step; onto the other side thereof, a step tread plate and a front edge strip can be fastened, which are also supported, in a positive-fitting manner, by a projecting ridge of the Z-profile.

FR 2 671 822 A1 discloses a multi-stage kit for the restoration of a step in a staircase. Said kit includes a stair edge, with, on one hand, a riser plate that rests flat against a riser, and, on the other hand, a step tread plate projecting from said stair edge. In order to hold the stair edge in a fixed position, it is, at least partially, embedded in mortar.

Additional suggestions for covering steps in a staircase to be renovated also include construction elements consisting of several parts, which are mounted on-site. Thus, for example, DE 35 42 952 A1 proposes the fastening of wooden strips, which project over the original height of the stair which has been worn away, the attachment of a U-shaped metal rail, which wraps around the nosing edge of said stair, and finally, the attachment of a wooden layer, including the impact strip, by means of assembly foam.

In order to restore a step in a staircase according to DE 35 17 673 C2, an L-shaped profile is provided, which covers the step tread and the nosing edge, whereby the step tread leg of said L-shaped profile exhibits an insert made of pressboard, which has a lower specific weight than plastic.

A prefabricated covering for a step in a staircase, according to EP 0 061 707 A2, exhibits a structure which includes at least three layers, which are bonded together across their entire contact surfaces in the area of the step tread edge.

DE 85 14 515 U1 describes a coating for the renovation of worn-out steps in a staircase, which consists of two legs made of tread- and abrasion-resistant plastic, said legs being attached to each other so as to form a single piece.

According to EP 0 312 488 B1, a W-shaped profile is screwed onto the riser of a step to be restored in order to be able to exercise the necessary support function with regard to a step tread plate, which is to be attached to the step tread. In order to keep the old step from squeaking, it is raised by a predetermined height through the use of a new riser. To this end, the new riser is clamped between the profile and a new step tread plate, which runs under the profile.

DE 80 26 427 U1 discloses a staircase step for use in the restoration of old buildings, whereby the old riser is covered by a cover plate, which emanates from a gap between a protruding edge of a new step and the step tread edge of the old step and extends to the previous new step.

A plurality of proposals known from prior art for the restoration of steps in staircases to be renovated similarly show construction elements consisting of several parts, or construction elements which only partially cover the step itself. By way of example, reference is hereby made to DE 86 04 260 U1, DE 80 26 427 U1, DE 85 04 095 U1 or DE 38 03 077 C2.

The present invention is based on the problem of developing a process for the renovation of a staircase, especially a wooden staircase, in such a way that the renovation becomes possible through the use of simple design measures, whereby even when the step tread surfaces to be covered as a result of the use, for example, of grease, wax or similar substances do not permit any durable attachment through the use of glue, secure fastening is possible. In addition, it is necessary to ensure that suitable sealing is provided between the new steps and the old ones so that moisture cannot enter the space.

The problem is basically solved according to the invention by means of the following procedural steps:

a) Removal of any layers from the step treads and risers, and any impact strips from the nosing edges of the steps.

b) Removal of any glue.

c) Attachment of new impact strips to the nosing edges.

d) Introduction of recesses into the step treads.

e) Renewed cleaning of the steps.

f) Introduction of a moisture-activated swelling glue into the recesses as well as onto the horizontal leg of the angle element of the step to be renovated immediately thereupon.

g) Assembly of a step tread plate and a riser plate in accordance with the dimensions of the step to be renovated.

h) Placing and pressing the step tread plate onto the step tread.

i) Lifting the step tread plate, moistening the glue, and again placing and pressing the step tread plate and holding it down with a weight.

j) Subsequent renovation of the step immediately below the step, which has just been renovated.

According to the invention, there is no real machining of the step to be renovated. Rather, all layers present, such as carpets, PVC tiles or the like, are completely removed. The same applies to impact strips, insofar as these are present. Subsequently, the steps to be renovated are measured in order to ensure proper cutting of step tread plates and riser plates made of prefabricated elements. The aforementioned plates are made of piece goods. Subsequently, a thorough cleaning of the staircase takes place, and angle elements, such as aluminum rails, are fastened to the nosing edges of the steps to be renovated, by means of screws and glue. Thereafter, through the use for example of a knot borer, boreholes with a diameter of for example 30 mm and a depth between 3 and 7 mm are introduced into the step tread surface to be renovated. These boreholes and/or blind holes are preferably arranged in straight lines which run parallel to the adjacent rear impact plate. Subsequently, the staircase to be renovated is again cleaned.

In accordance with the measured dimensions of the steps to be renovated, properly trimmed step tread plates and riser plates are assembled for the step to be renovated. In the course of said assembly, the top edge of the riser plate is introduced into the step tread plate, which exhibits a groove on the underside of the nosing edge. After a moisture-activated swelling glue has been introduced into or applied to the boreholes as well as the horizontal leg of the angle element, the step tread plate, with the riser plate introduced into the groove on the underside thereof, is placed on top of the step tread surface to be renovated, in order to distribute any protruding glue. The step tread plate is then lifted off again, the glue is moistened, and the step tread plate is re-placed on top of the step tread surface and held down with a weight. The interval of time during which the weight remains on the step tread plate is preferably between 15 and 30 minutes. At the same time, the riser plate is pressed in the direction of the riser, with no necessity for a rigid connection with the riser. While the step tread plate is being held down with a weight, the next lower step can be prepared for restoration by means of the process described above. This process is successively performed along the staircase, from top to bottom, until the entire staircase, including a landing, has been renovated.

When trimming the step tread plate, care must be taken to ensure that on the step tread plate fastened to the step tread grooves remain between the step tread plate and surrounding elements, such as the cheeks and the riser. These grooves will subsequently be filled with a sealing material, such as silicon.

Naturally, the order of the procedural steps described above can be changed to the extent required in order to enable the renovation to proceed as efficiently as possible. Thus, for example, step tread plates and riser plates may be trimmed prior to the cleaning and treatment of the steps to be renovated. In addition, the boreholes may be incorporated in the step treads before the angle elements fastened. Furthermore, a final cleaning of the steps may be postponed until all of the preliminary processes—such as, for example, the introduction of the boreholes and the fastening of the strips—have been completed. Moreover, the cheeks should be treated and restored as necessary, prior to the renovation of the steps, in order to achieve the desired appearance.

The renovation process according to the invention is especially suitable for wooden staircases. Naturally, however, stone or concrete staircases may also be renovated in a similar manner.

With regard to wooden staircases, it should also be noted that the frequently occurring, but undesirable, phenomenon of squeaking can be prevented by attaching the old riser to the step tread. This can be done by means of a screw extending from the step tread surface to the step tread to be renovated.

Additional details, advantages and features of the invention result not only from the claims, and the features revealed therein, but may also be understood—singly and/or in combination—from the following description of preferred embodiments derived from the drawings, which show:

FIG. 1 a cross-section through a renovated step of a staircase, and

Figure 2:
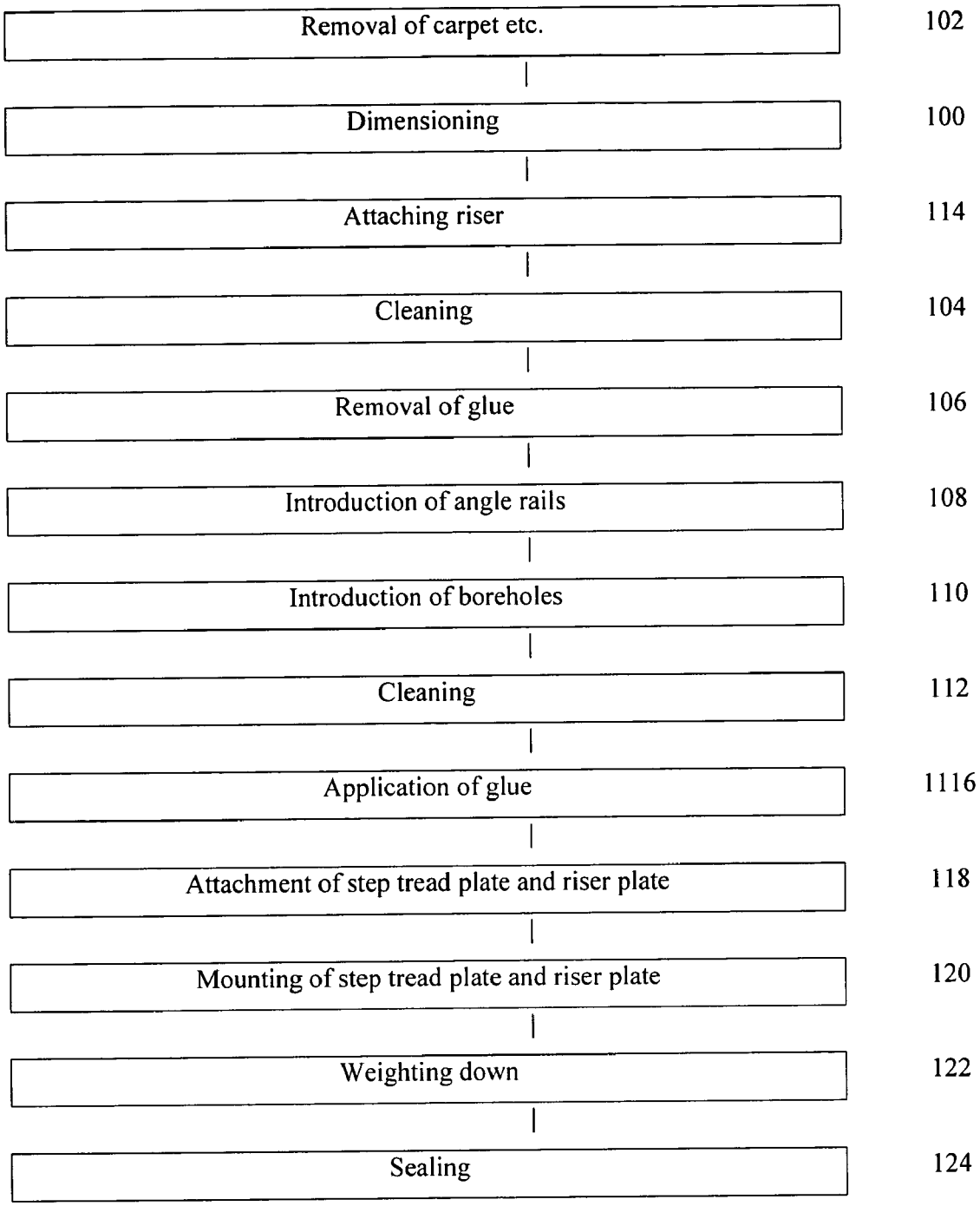

FIG. 2 the course of a process for the renovation of a staircase.

Initially, an explanation will be given of a renovated step as shown in FIG. 1. Thus, FIG. 1 shows a cross-section of a step 10 in a staircase, said step consisting, in a manner known from prior art, of a step tread 12 with a step tread surface 14, and a riser 16 with an impact surface 18. The step tread 12 includes a projection over the impact surface 18, so as to form a nosing edge 20.

In order to renovate the step 10, said step is encased with a staircase construction element 24, which consists of a step tread plate 26 with a front step tread edge area 28, as well as a riser plate 30. The step tread plate 26 and the riser plate 30 are trimmed from available piece goods, according to the dimensions of the step 10 to be renovated.

Attached and screwed (by means of screws 70) to the nosing edge 20 of the renovated step 10 is an angular profile 32, preferably made of aluminum, whereby one leg 34 of said angular profile runs along the step tread surface 14 and the other leg 36 thereof runs along the front surface 22 of the nosing edge 20.

In addition, the step tread edge area 28 of the step tread plate 26 extends in sections along the leg 36 of the angular profile 32 and rests against it with its surfaces.

In order to secure the riser plate 30 in relation to the step tread plate 26 through the use of simple means, the underside 46 of said plate exhibits a groove 48, which is slanted in the outer area—that is, the front area 50—in order to enable the simple introduction of the riser plate 30, even if the step tread plate 26 should already have been mounted.

With its other end 54, the riser plate 30 is supported by the step tread surface 56 of the preceding, i.e. the lower step, which is to be renovated after step 10.

The riser plate 30 is composed of two outer sections 60, 62 and a middle section 64 which transitions steadily into said outer sections, whereby the outer sections 60, 62 run parallel or approximately parallel to each other, and the section 60, which is closest to the step tread plate, is significantly shorter than the other section 62, and especially shows a length dimension which is equal to or shorter than the height of the nosing edge 20.

No additional fastening of the riser plate 30 is required because the area 54 of said riser plate is fixed in position by means of a step tread plate 68, which extends along the preceding step tread surface 56. In other words, one end of the riser plate is introduced into the groove 48, and the other is clamped fast between the step tread plate 68 and the impact surface 18, and, basically speaking, no additional fastening means are required.

The angle element 32 is attached to the nosing edge 20 by means of screws 70, especially Phillips screws. Furthermore, a connection, shown by a dotted line 72, between the step tread 12 and the riser 16 can be established in order to prevent squeaking. To this end, the riser 16 is pulled toward the step tread 12.

The connection between the step tread plate 26 and the step tread 12 or step tread surface 14 is implemented by means of moisture-activated glue, which is introduced into the boreholes 74, 76. In addition, suitable adhesive can also be applied to the external surface of the leg 34 of the angle 32 and to the underside of the step tread plate 26.

The moisture-activated glue exhibits swelling properties, with the result that the space that develops, as a result of the angle 32 and/or the horizontal leg 34, between the step tread surface 14 and the underside of the step tread plate 26 is filled to the extent that the top 78 of the step tread plate 26 runs horizontally to the required extent.

The recesses 74, 76 are introduced in the step tread 12 preferably by means of a knot borer, and can exhibit diameters of approximately 30 mm and depths of between 3 and 7 mm.

In addition, existing or intentionally formed grooves between the step tread plate and the cheeks or the riser are sealed, so as to prevent moisture from penetrating. In FIG. 1, the sealing between the step tread plate 68 and the riser 30 is designated by the number 69.

The renovation or restoration process according to the invention, for use on staircases, is described below in greater detail by means of FIG. 2.

Initially, by means of a procedural step 102, any layers present, such as carpets or PVC tiles, are removed from the steps and/or the landing to be renovated. In addition, any impact strips, which are fastened to the nosing edges of the steps, are also removed. Immediately thereafter, fine measurement is performed on the staircase to be renovated—i.e., on the steps thereof, including the landing, if any (procedural step 100). Subsequently, a thorough cleaning of the staircase is preferably performed (step 104). Thereafter, any remaining traces of glue or PVC are removed—for example, by means of a spatula (procedural step 106). In the following procedural steps (108, 110)—the order whereof may be changed as necessary—angular rails are installed on the nosing edges and fastened by means of glueing or, for example, by means of screws. In addition, recesses, such as knot boreholes, which, for example, may have a diameter of 30 mm and a depth of between 3 and 7 mm, are introduced into the respective step. Subsequently, another cleaning of the steps and the landing is performed (procedural step 112). During this step, which almost amounts to a preliminary process, it is also possible to pull the risers closer to the respective step treads, in order to prevent squeaking. This can be done by means of a screw, which penetrates the step tread, such as a Phillips screw (procedural step 114). Pulling the risers closer is preferably done according to the dimensions (procedural step 100).

Immediately thereafter, the boreholes are filled with moisture-activated glue. Suitable glues also applied to the horizontal leg of the angle element and smoothed as necessary (procedural step 116).

During this process, the glue is introduced into the boreholes and/or applied to the angular rail to such an extent that the step tread plate to be attached, along with its step tread surface, runs horizontally or basically horizontally—so that the space between the step tread surface of the step tread to be renovated and the underside of the step tread plate, which is formed by the thickness of the horizontal leg of the angle element, is sufficiently filled. To this end, it should be taken into consideration that the moisture-activated glue will swell. The glue should only be introduced into the boreholes, and/or spread on the angular rail of the step, which is about to be renovated or restored. Immediately thereafter, or even before the introduction or application of the glue, the step tread plate is attached to the riser plate (procedural step 118), thereby the dimensions of the step tread plate must be based on those of the step tread to be covered in such a way as to ensure a groove at the edge of the step tread, which will subsequently be filled with a sealing material, such as silicon. Such grooves will frequently also develop with fitted dimensions, due to the unevenness of the cheek surfaces.

The riser is inserted in the grove running along the underside of the step tread plate, in the area of the nosing edge, whereby the length of the riser plate is adjusted to the height of the riser to be covered.

The respective riser plate and step tread plate are trimmed according to the dimensions of the piece goods supplied.

The step tread plate and riser plate are then mounted onto the step to be renovated (procedural step 120). In so doing, first the step tread plate is placed on the step tread surface and then lifted upward, the adhesive is supplied with moisture—for example, by spraying it with water, and the step tread plate is then immediately replaced on the step tread surface and held down with a weight (procedural steps 120, 122).

The time interval during which the weight remains on the step tread plate is preferably between 15 and 30 minutes. During this time, the next, i.e. lower, step can be prepared, and the step tread plate and riser plate can be assembled accordingly.

When all of the steps have been encased, the intentionally provided grooves are sealed (procedural step 124).

What is claimed is:

1. Process for the renovation of the steps of a staircase, comprising step treads and risers, whereby, starting from the top step to be renovated, starting on the step tread thereof, a step tread plate provided with an impact section that protrudes beyond the step tread is arranged and fastened, and whereby, starting from said impact section, a riser plate extends along the riser and is fastened in the area of the corresponding next lower step to be renovated, wherein said process is characterized by the following procedural steps:

a) Removal of any layers from the step treads and risers, and any impact strips from the nosing edges of the step, b) Removal of any glue, c) Attachment of new impact strips to the nosing edges, d) Introduction of recesses into the step treads, e) Renewed cleaning of the steps, f) Introduction of a moisture-activated swelling glue into the recesses as well as onto a horizontal leg of an angle element of the step to be renovated immediately thereupon, g) Assembly of a step tread plate and a riser plate in accordance with the dimensions of the step to be renovated, h) Placing and pressing the step tread plate onto the step tread, i) Lifting the step tread plate, moistening the glue, and again placing and pressing the step tread plate and holding it down with a weight, j) Subsequent renovation of the step immediately below the step, which has just been renovated, whereby procedural steps a) to f) are performed in a single operation for all of the steps to be renewed, and procedural steps g) to i) are sequentially performed for each step to be renovated.

2. Procedure according to claim 1, wherein dimensions for the step tread plate and the riser plate are taken after procedural step a).

3. Procedure according to claim 1, wherein the step tread plate is placed on the step tread surface of the step to be renewed in such a way that grooves are formed around the edges of the step tread plate attached to the step tread surface, and said grooves are filled with a sealing material.

4. Procedure according to claim 1, wherein blind boreholes are bored as recesses in the step treads.

5. Procedure according to claim 4, wherein the blind boreholes have a depth of 3 mm$\leqq$T$\leqq$7 mm.

6. Procedure according to claim 4, wherein the blind boreholes are introduced in the step tread along at least two lines which run parallel or approximately parallel to the riser.

7. Procedure according to claim 1, wherein glue is introduced into or applied to the boreholes and/or the step tread surface to such an extent that the space between the step tread surface of the step to be renovated and the plane established by the leg of the angle element which runs along the step tread surface is filled at least in some areas.

8. Procedure according to claim 4, wherein the riser of the step to be renovated is pulled toward the step tread and attached thereto by means of a screw element originating in the step tread.

* * * * *